US006446588B2

(12) United States Patent
Yamada et al.

(10) Patent No.: US 6,446,588 B2
(45) Date of Patent: Sep. 10, 2002

(54) INTERNAL COMBUSTION ENGINE HAVING ELECTROMAGNETIC VALVE DRIVING MECHANISM AND METHOD OF CONTROLLING ELECTROMAGNETIC VALVE DRIVING MECHANISM

(75) Inventors: Tomomi Yamada; Isao Matsumoto; Kazuhiko Shiratani, all of Susono; Shouji Katsumata, Gotemba; Keiji Yoeda, Numazu; Hideyuki Nishida, Susono, all of (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/842,822

(22) Filed: Apr. 27, 2001

(30) Foreign Application Priority Data

May 29, 2000 (JP) ..... 2000-159226

(51) Int. Cl.[7] ..... F01L 9/04

(52) U.S. Cl. ..... 123/90.11; 123/90.19; 123/90.33

(58) Field of Search ..... 123/90.11, 90.19, 123/90.33, 90.35; 251/129.1, 129.15, 129.16

(56) References Cited

U.S. PATENT DOCUMENTS 5,730,091 A * 3/1998 Diehl ..... 123/90.11
5,799,630 A * 9/1998 Moriya ..... 123/90.11
5,799,926 A 9/1998 Moriya et al.
6,216,652 B1 * 4/2001 Gramann ..... 123/90.11
6,321,700 B1 * 11/2001 Hein ..... 123/90.11

FOREIGN PATENT DOCUMENTS

| | | | | |
|---|---|---|---|---|
| DE | 197 39 840 A1 | | 3/1999 | |
| EP | 1 076 163 A2 | | 2/2001 | |
| JP | 40-3130540 | * | 6/1991 | ..... 137/341 |
| JP | 404347081 A | * | 12/1992 | ..... 251/129.15 |
| JP | A 07-335437 | | 12/1996 | |
| JP | A 11-036829 | | 2/1999 | |
| JP | A 2000-145425 | | 5/2000 | |

* cited by examiner

*Primary Examiner*—Thomas Denion
*Assistant Examiner*—Jaime Corrigan
(74) *Attorney, Agent, or Firm*—Oliff & Berridge, PLC

(57) ABSTRACT

An internal combustion engine having an electromagnetic valve driving mechanism adjusts an amount of magnetizing current to be applied to the electromagnetic valve driving mechanism in accordance with a temperature or viscosity of a lubricant used in the electromagnetic valve driving mechanism. Accordingly, intake and exhaust valves can be driven with an electromagnetic force corresponding to a viscosity of the lubricant. Therefore, changes in opening-and-closing operation speeds of the intake and exhaust valves resulting from a temperature or viscosity of the lubricant that is supplied to a sliding portion of the electromagnetic valve driving mechanism can be reduced.

10 Claims, 6 Drawing Sheets

INTERNAL COMBUSTION ENGINE HAVING ELECTROMAGNETIC VALVE DRIVING MECHANISM AND METHOD OF CONTROLLING ELECTROMAGNETIC VALVE DRIVING MECHANISM

INCORPORATION BY REFERENCE

The disclosure of Japanese Patent Application No. 2000-159226 filed on May 29, 2000, including the specification, drawings, and abstract is incorporated herein by reference in its entirety.

BACKGROUND OF THE INVENTION

1. Field of Invention

The invention relates to an internal combustion engine having an electromagnetic valve driving mechanism that drives at least one of intake and exhaust valves by means of an electromagnetic force generated by application of a magnetizing current thereto, and to a method of controlling the electromagnetic valve driving mechanism.

2. Description of Related Art

In recent years, in the field of an internal combustion engine installed in an automobile or the like, development of an electromagnetic valve driving mechanism capable of arbitrarily changing timings for opening and closing intake and exhaust valves has been promoted for the purpose of preventing mechanical loss resulting from the driving of the intake and exhaust valves in their opening and closing directions, reducing pumping loss of intake air, improving net thermal efficiency, and so on.

As an example of the electromagnetic driving mechanism, a mechanism having a slider, a closing electromagnet, an opening electromagnet, and an elastic member has been proposed. The slider has a magnetic material and slides in cooperation with intake and exhaust valves. The closing electromagnet generates an electromagnetic force that displaces the slider in its closing direction upon application of a magnetizing current thereto. The opening electromagnet generates an electromagnetic force that displaces the slider in its opening direction upon application of a magnetizing current thereto. The elastic member elastically supports the slider at a neutral position between an opening-side displacement end and a closing-side displacement end.

Because such an electromagnetic valve driving mechanism eliminates the necessity to drive intake and exhaust valves in their opening and closing directions by means of a rotational force of an engine output shaft (crankshaft) as in the case of a conventional valve mechanism, mechanical loss resulting from the driving of the intake and exhaust valves is reduced.

Furthermore, the above-described electromagnetic valve driving mechanism can drive the intake and exhaust valves independently of rotating motions of the engine output shaft, and thus has many advantages including a high degree of freedom in controlling timings for opening and closing the intake and exhaust valves, openings of the intake and exhaust valves, etc.

On the other hand, in an electromagnetic valve driving mechanism as described above, when the slider and the intake and exhaust valves are displaced, friction occurs in sliding portions of the slider and the intake and exhaust valves.

Therefore, the necessity to apply a relatively great amount of magnetizing current to the opening electromagnet and to the closing electromagnet for the purpose of displacing the slider against the friction constitutes a problem.

In order to address such a problem, an electromagnetic valve driving mechanism as disclosed in Japanese Patent Application Laid-Open No. 11-36829 has been proposed. The electromagnetic valve driving mechanism disclosed in this publication has a shaft member for transmitting an electromagnetic force to a valve body, and a bearing portion for slidably holding the shaft member. The electromagnetic driving mechanism has a lubricating oil supplying mechanism that supplies lubricating oil to the bearing portion. Therefore, the occurrence of friction between the shaft member and the bearing portion is suppressed. Thus, precise sliding movements of the shaft member are ensured while reducing an amount of magnetizing current that needs to be applied to the electromagnets.

Lubricating oil supplied to an electromagnetic valve driving mechanism as described above has a feature wherein its viscosity changes depending on a temperature of the lubricating oil. For instance, the viscosity of the lubricating oil increases in proportion to a fall in temperature thereof, whereas the viscosity of the lubricating oil decreases in proportion to a rise in temperature thereof.

Therefore, in an electromagnetic valve driving mechanism as described above, sliding resistance (friction resistance) of a shaft member increases when the lubricating oil is at a low temperature. On the other hand, sliding resistance of the shaft member decreases when the lubricating oil is at a high temperature. As a result, the operation speed of the shaft member changes depending on a temperature of the lubricating oil, and therefore the operation speed of intake and exhaust valves may change depending on a temperature of the lubricating oil.

SUMMARY OF THE INVENTION

It is an object of the invention to provide an electromagnetic valve driving mechanism that drives at least one of intake and exhaust valves in opening and closing directions by means of an electromagnetic force while making it possible to reduce changes in opening-and-closing operation speeds of the intake and exhaust valves resulting from a temperature or viscosity of the lubricant that is supplied to a sliding portion of the electromagnetic valve driving mechanism.

An internal combustion engine having an electromagnetic valve driving mechanism according to the invention has a lubricant temperature determining device and a controller that adjusts an amount of magnetizing current supplied to the electromagnetic valve driving mechanism.

The electromagnetic valve driving mechanism drives at least one of the intake and exhaust valves of the internal combustion engine in opening and closing directions by means of an electromagnetic force that is generated upon application of a magnetizing current thereto. The lubricant temperature determining device determines (i.e., it detects or estimates) a temperature of lubricant supplied to a sliding portion of the electromagnetic valve driving mechanism, the intake valve, or the exhaust valve. The controller adjusts an amount of magnetizing current supplied to the electromagnetic valve driving mechanism in accordance with the temperature of the lubricant that has been detected or estimated by the lubricant temperature determining device.

In an internal combustion engine having an electromagnetic valve driving mechanism thus constructed, when an intake valve or an exhaust valve is operated in its opening and closing directions, a lubricant temperature determining device first detects or estimates a temperature of the lubricant. A controller adjusts an amount of magnetizing current to be supplied to the electromagnetic valve driving mechanism in accordance with the temperature of lubricant that has been detected or estimated by the lubricant temperature determining device.

For example, the controller may increase an amount of magnetizing current supplied to the electromagnetic valve driving mechanism in proportion to a decrease in temperature of the lubricant that has been detected or estimated by the lubricant temperature determining device.

In this case, the amount of magnetizing current applied to the electromagnetic valve driving mechanism increases in proportion to a decrease in temperature of the lubricant, i.e., in proportion to an increase in viscosity of the lubricant. On the other hand, the amount of magnetizing current applied to the electromagnetic valve driving mechanism decreases in proportion to an increase in temperature of the lubricant, i.e., in proportion to a decrease in viscosity of the lubricant.

As a result, the electromagnetic valve driving mechanism generates a relatively great electromagnetic force when the lubricant has a high viscosity, and generates a relatively small electromagnetic force when the lubricant has a low viscosity. That is, the intake and exhaust valves are driven with a relatively great electromagnetic force when the lubricant has a high viscosity, and are driven with a relatively small electromagnetic force when the lubricant has a low viscosity.

Thus, the intake and/or exhaust valve is driven with an electromagnetic force which is determined by taking the viscosity of the lubricant into account. Therefore, changes in opening-and-closing operation speeds of the intake and exhaust valves resulting from a temperature or viscosity of the lubricant can be reduced.

BRIEF DESCRIPTION OF THE DRAWINGS

The invention will be described in conjunction with the following drawings in which like reference numerals identify like elements and wherein.

DETAILED DESCRIPTION OF PREFERRED EMBODIMENTS

Hereinafter, an internal combustion engine having an electromagnetic valve driving mechanism according to first embodiment of the invention will be described with reference to the drawings.

Figure 1:
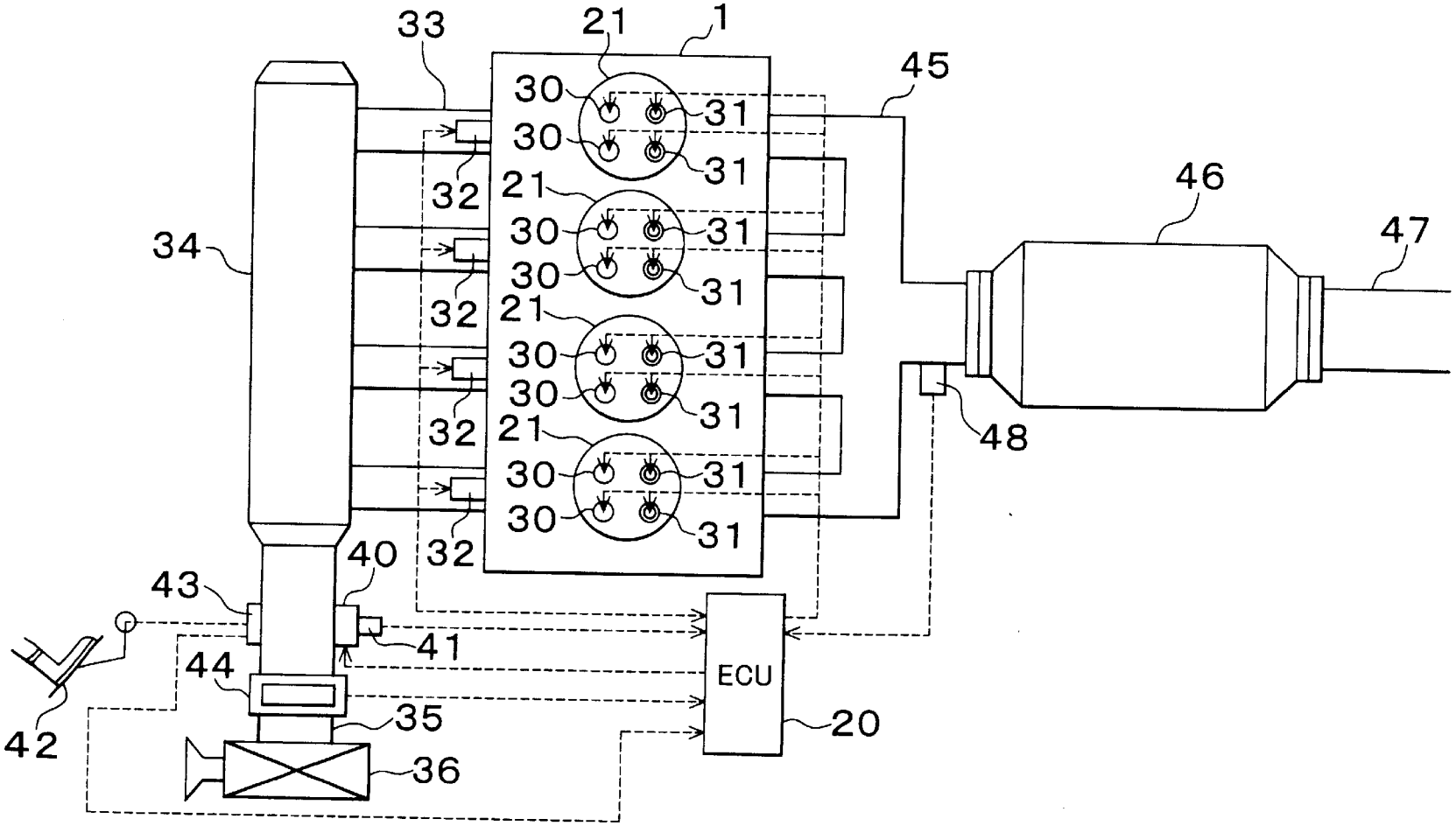
FIG. 1 is an overall plan view of an internal combustion engine having an electromagnetic valve driving mechanism according to first embodiment of the invention.
Figure 2:
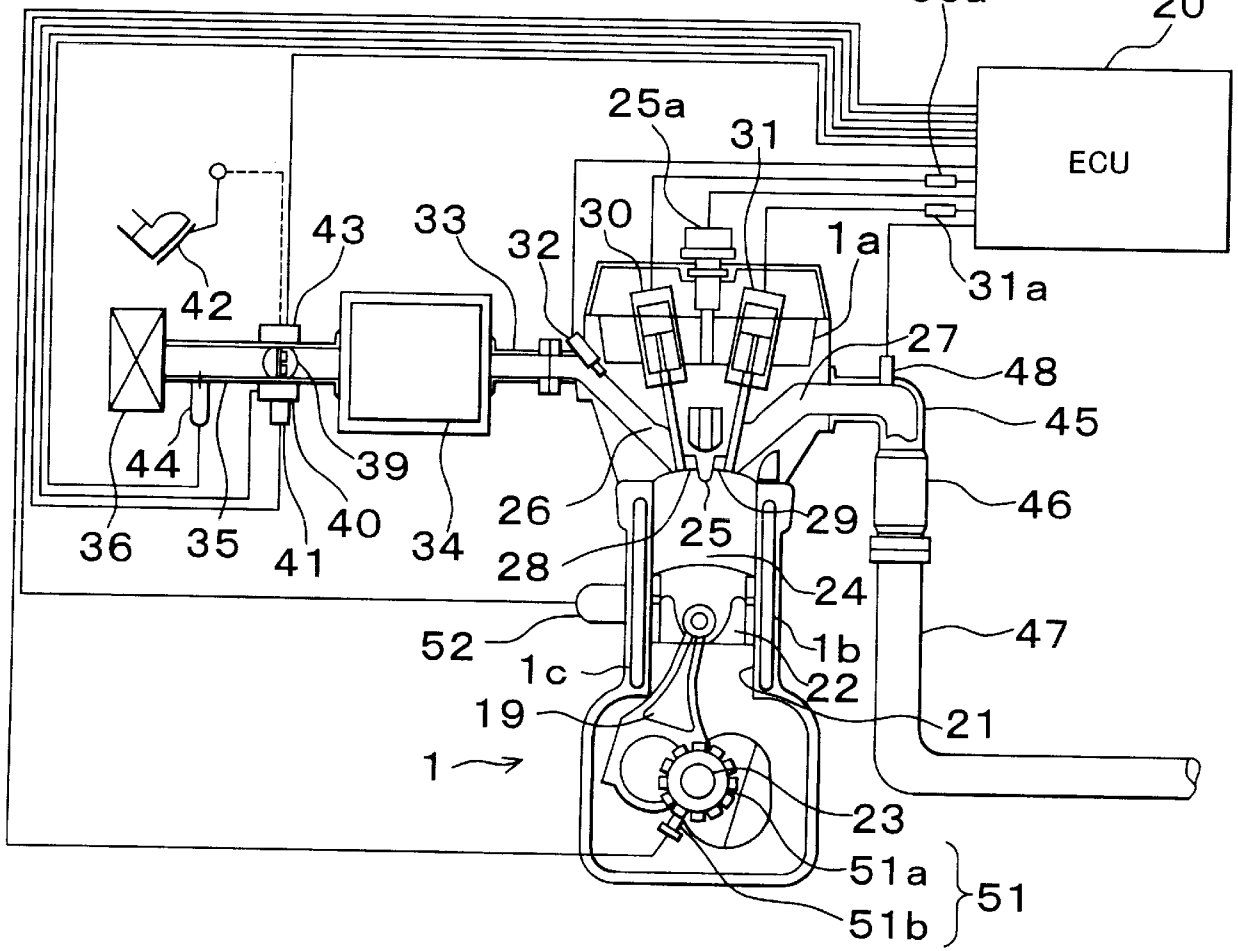
FIG. 2 is an overall view of the internal structure of the internal combustion engine according to the first embodiment of the invention.

FIGS. 1 and 2 show overall structures of an internal combustion engine and its intake and exhaust systems according to an embodiment of the invention. An internal combustion engine 1 shown in FIGS. 1 and 2 is a four-stroke-cycle water-cooled gasoline engine equipped with four cylinders 21.

The internal combustion engine 1 has a cylinder block 1*b* and a cylinder head 1*a*. The four cylinders 21 and a coolant passage 1*c* are formed in the cylinder block 1*b*. The cylinder head la is fixed to an upper portion of the cylinder block 1*b*.

A crankshaft 23 as an engine output shaft is rotatably supported by the cylinder block 1*b*. The crankshaft 23 is connected to a piston 22 via a connecting rod 19. A piston 22 is slidably inserted into each of the cylinders 21.

The crankshaft 23 is fitted at an end thereof with a timing rotor 51*a* that has a plurality of teeth along its periphery. An electromagnetic pick-up 51*b* is fitted to the cylinder block 1*b* at a position close to the timing rotor 51*a*. The timing rotor 51*a* and the electromagnetic pick-up 51*b* constitute a crank position sensor 51.

The cylinder block 1*b* is fitted with a coolant temperature sensor 52 that outputs an electric signal corresponding to a temperature of coolant flowing through the coolant passage 1*c*.

A combustion chamber 24 that is surrounded by a top face of the piston 22 and a wall surface of the cylinder head 1*a* is formed above the piston 22 of each of the cylinders 21. An ignition plug 25 is fitted to the cylinder head 1*a* in such a manner as to face the combustion chamber 24 of each of the cylinders 21. An igniter 25*a* for applying a driving current to the ignition plug 25 is connected thereto.

Two opening ends of an intake port 26 and two opening ends of an exhaust port 27 are formed in the cylinder head 1*a* in a region that faces the combustion chamber 24 of each of the cylinders 21. Intake valves 28 for opening and closing the opening ends of the intake port 26 and exhaust valves 29 for opening and closing the opening ends of the exhaust port 27 are provided in the cylinder head 1*a* in a reciprocating manner.

Intake-side electromagnetic driving mechanisms 30 that are equal in number to the intake valves 28 are provided in the cylinder head 1*a*. Using an electromagnetic force generated upon application of a magnetizing current thereto, the intake-side electromagnetic driving mechanisms 30 drive the intake valves 28 in a reciprocating manner. An intake-side driving circuit 30*a* is electrically connected to each of the intake-side electromagnetic driving mechanisms 30. The intake-side driving circuit 30*a* serves to apply a magnetizing current to a corresponding one of the intake-side electromagnetic driving mechanisms 30.

Exhaust-side electromagnetic driving mechanisms 31 that are equal in number to the exhaust valves 29 are provided in the cylinder head 1*a*. Using an electromagnetic force generated upon application of a magnetizing current thereto, the exhaust-side electromagnetic driving mechanisms 31 drive the exhaust valves 29 in a reciprocating manner. An exhaust-side driving circuit 31*a* is electrically connected to each of the exhaust-side electromagnetic driving mechanisms 31. The exhaust-side driving circuit 31*a* serves to apply a magnetizing current to a corresponding one of the exhaust-side electromagnetic driving mechanisms 31.

Hereinafter, specific structures of the intake-side electromagnetic driving mechanisms 30 and the exhaust-side electromagnetic driving mechanisms 31 will be described. Because the intake-side electromagnetic driving mechanisms 30 and the exhaust-side electromagnetic driving mechanisms 31 are structurally identical, the following description will refer only to the intake-side electromagnetic driving mechanisms 30 as an example.

Figure 3:
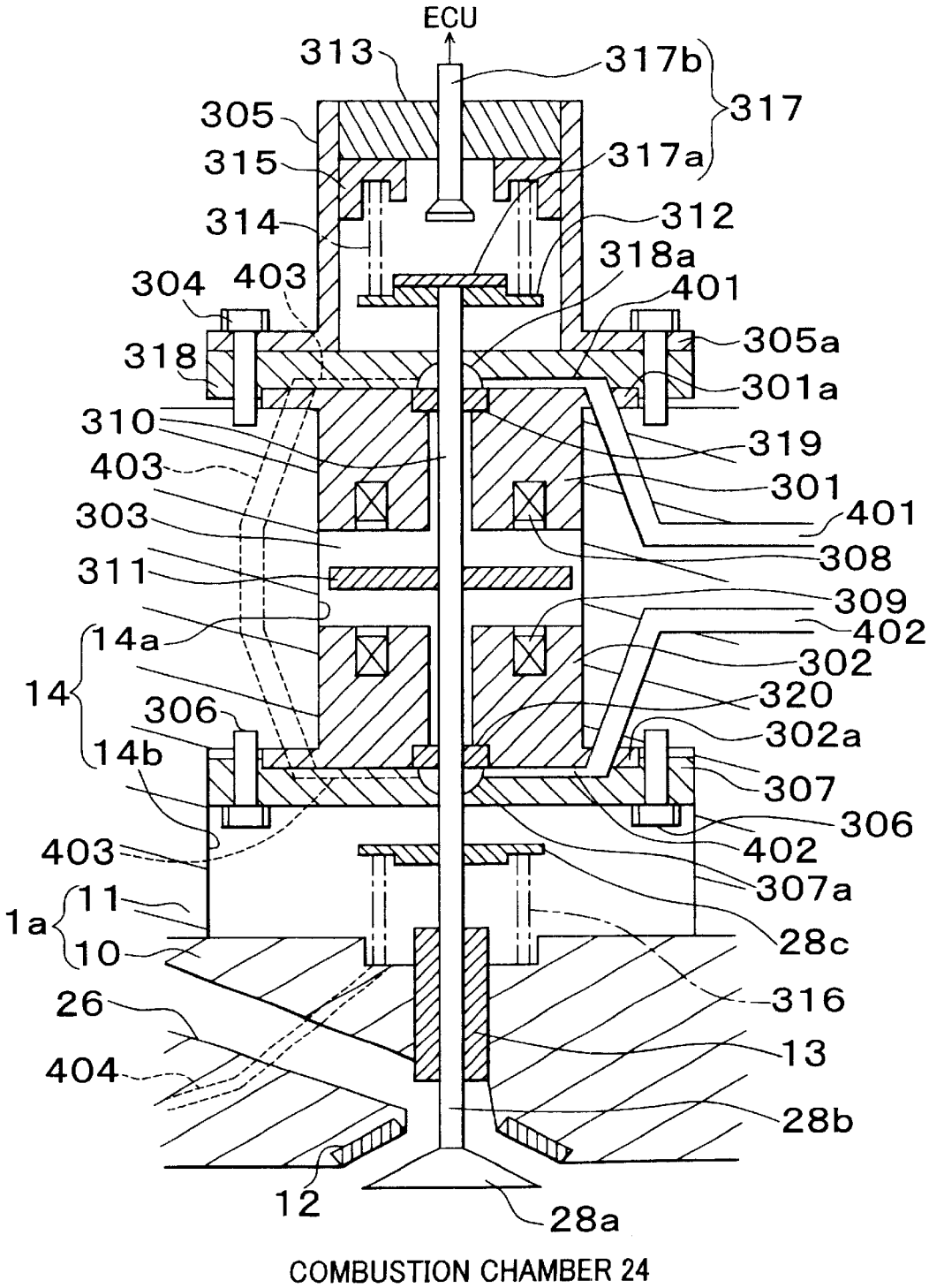
FIG. 3 shows the internal structure of an intake-side electromagnetic driving mechanism according to the first embodiment of the invention.

FIG. 3 is a sectional view of the structure of one of the intake-side electromagnetic driving mechanisms 30. In FIG. 3, the cylinder head 1*a* of the internal combustion engine 1 has a lower head 10 and an upper head 11. The lower head 10 is fixed to an upper face of the cylinder block 1*b*. The upper head 11 is provided on the lower head 10.

Two intake ports 26 are formed in the lower head 10 for each of the cylinders 21. A valve seat 12, on which a valve body 28*a* of a corresponding one of the intake valves 28 sits, is provided in the opening end of each of the intake ports 26 on the side of the combustion chamber 24.

A through-hole that is circular in cross-section and that extends from an inner wall surface of each of the intake ports 26 to the upper surface of the lower head 10 is formed in the lower head 10. A tubular valve guide 13 is inserted into the through-hole. A valve shaft 28*b* of the intake valve 28 passes through an inner hole in the valve guide 13 and is slidable in the axial direction.

A core fitting hole 14 that is circular in cross-section is provided in the upper head 11 in a region that is coaxial with the valve guide 13. A first core 301 and a second core 302 are fitted into the core fitting hole 14. A lower portion of the core fitting hole 14 is larger in diameter than an upper portion of the core fitting hole 14. Hereinafter, the lower portion of the core fitting hole 14 will be referred to as a large-diameter portion 14*b*, and the upper portion of the core fitting hole 14 will be referred to as a small-diameter portion 14*a*.

A first core 301 and a second core 302 are axially fitted in series into the small-diameter portion 14*a* with a predetermined clearance 303 between them. The first core 301 and the second core 302 are annular members made of a soft magnetic material. A flange 301*a* is formed at an upper end of the first core 301. The first core 301 is fitted into the core fitting hole 14 from above. The flange 301*a* abuts on an edge of the core fitting hole 14, whereby the first core 301 is positioned. A flange 302*a* is formed at a lower end of the second core 302. The second core 302 is fitted into the core fitting hole 14 from below. The flange 302*a* abuts on an edge of the core fitting hole 14, whereby the second core 302 is positioned. Therefore, the predetermined clearance 303 is maintained between the first core 301 and the second core 302.

An upper plate 318 constructed of an annular member that has an outer diameter larger than a diameter of the flange 301*a* is disposed above an upper portion of the first core 301. A tubular upper cap 305 is disposed above an upper portion of the upper plate 318. A flange 305*a* that has an outer diameter substantially equal to a diameter of the upper plate 318 is formed at a lower end of the upper cap 305.

The upper cap 305 and the upper plate 318 are fixed to an upper surface of the upper head 11 by bolts 304. The bolts 304 penetrate into the upper head 11 via the upper plate 318 from an upper surface of the flange 305*a* of the upper cap 305.

In this case, the lower end of the upper cap 305 including the flange 305*a* abuts on an upper surface of the upper plate 318. The upper plate 318 is fixed to the upper head 11, with a lower surface of the upper plate 318 abutting on a peripheral portion of an upper surface of the first core 301. As a result, the first core 301 is fixed to the upper head 11.

A lower plate 307 made of an annular member that has an outer diameter substantially equal to the diameter of the large-diameter portion 14*b* of the core fitting hole 14 is provided below a lower portion of the second core 302. The lower plate 307 is fixed to a downwardly directed stepped surface in a stepped portion between the small-diameter portion 14*a* and the large-diameter portion 14*b*, by bolts 306 that penetrate into the upper head 11 from below a lower surface of the lower plate 307. In this case, the lower plate 307 is fixed while abutting on a peripheral portion of a lower surface of the second core 302. As a result, the second core 302 is fixed to the upper head 11.

A first electromagnetic coil 308 is held by a groove that is formed in a surface of the first core 301 on the side of the clearance 303. A second electromagnetic coil 309 is held by a groove that is formed in a surface of the second core 302 on the side of the clearance 303. The first electromagnetic coil 308 and the second electromagnetic coil 309 are disposed at such locations that they face each other via the clearance 303. The first electromagnetic coil 308 and the second electromagnetic coil 309 are electrically connected to the intake-side driving circuit 30*a*.

The first core 301 and the first electromagnetic coil 308 operate as an electromagnet. The second core 302 and the second electromagnetic coil 309 also operate as an electromagnet.

An armature 311 made of an annular soft magnetic material that has an outer diameter smaller than an inner diameter of the clearance 303 is disposed in the clearance 303. An armature shaft 310 is fixed to a hollow central portion of the armature 311 and can extend vertically along an axial centerline of the armature 311. The armature shaft 310 is made of a columnar non-magnetic material that has an outer diameter smaller than a diameter of the hollow portions of the first core 301 and the second core 302.

An upper end of the armature shaft 310 is formed in such a manner as to reach the inside of the upper cap 305 through the hollow portion of the first core 301. A lower end of the armature shaft 310 is formed in such a manner as to reach the inside of the large-diameter portion 14*b* through the hollow portion of the second core 302.

In accordance therewith, an annular upper bush (bearing portion) 319 that has an inner diameter substantially equal to an outer diameter of the armature shaft 310 is provided at an upper end of the hollow portion of the first core 301. Also, an annular lower bush (bearing portion) 320 that has an inner diameter substantially equal to an outer diameter of the armature shaft 310 is provided at a lower end of the hollow portion of the second core 302. The armature shaft 310 is axially slidably held by the upper bush 319 and the lower bush 320.

An upper retainer 312 in the shape of a circular plate is connected to the upper end of the armature shaft 310 that extends into the upper cap 305. An adjusting bolt 313 is screwed into an upper opening of the upper cap 305. An upper spring 314 is interposed between the upper retainer 312 and the adjusting bolt 313. A spring seat 315 that has an outer diameter substantially equal to an inner diameter of the upper cap 305 is interposed between an abutment surface of the adjusting bolt 313 and an abutment surface of the upper spring 314.

An upper end of the valve shaft 28*b* of the intake valve 28 abuts on the lower end of the armature shaft 310 that extends into the large-diameter portion 14*b*. A lower retainer 28*c* in the shape of a circular disc is connected to an outer periphery of the upper end of the valve shaft 28*b*. A lower spring 316 is interposed between a lower surface of the lower retainer 28*c* and the upper surface of the lower head 10.

In the intake-side electromagnetic driving mechanism 30 thus constructed, when no magnetizing current is applied to the first electromagnetic coil 308 and the second electromagnetic coil 309 from the intake-side driving circuit 30*a*, an urging force acts downward from the upper spring 314 to the armature shaft 310 (i.e., in a direction in which the intake valve 28 is opened), and an urging force acts upward from the lower spring 316 to the intake valve 28 (i.e., in a direction in which the intake valve 28 is closed). As a result, the armature shaft 310 and the intake valve 28 are maintained in a so-called neutral state in which they abut against each other and are elastically supported at predetermined positions.

Urging forces of the upper spring 314 and the lower spring 316 are set such that a neutral position of the armature 311 becomes a central position between the first core 301 and the second core 302 in the clearance 303. If the neutral position of the armature 311 has deviated from the aforementioned central position due to the initial tolerance, aging, etc. of component members, adjustment can be made by the adjusting bolt 313 such that the neutral position of the armature 311 coincides with the central position.

Axial lengths of the armature shaft 310 and the valve shaft 28*b* are set such that the valve body 28*a* is at a central position between an opening-side displacement end and a closing-side displacement end (hereinafter referred to as a half-open position) when the armature 311 is at the central position in the clearance 303. Furthermore, axial lengths of the armature shaft 310 and the valve shaft 28*b* are set such that the valve seat 28*a* sits on the valve seat 12 when the armature 311 abuts on the first core 301.

In the above-described intake-side electromagnetic driving mechanism 30, when a magnetizing current is applied to the first electromagnetic coil 308 from the intake-side driving circuit 30*a*, an electromagnetic force that acts in such a direction as to displace the armature 311 toward the first core 301 is generated between the side of the first core 301 (the first electromagnetic coil 308) and the armature 311. Therefore, the armature 311 is displaced toward its closing side against an urging force of the upper spring 314 and comes into abutment on the first core 301.

When the armature 311 abuts on the first core 301, the intake valve 28 retreats while receiving an urging force of the lower spring 316, and assumes a state in which the valve body 28*a* of the intake valve 28 sits on the valve seat 12, i.e., a fully-closed state.

In the above-described intake-side electromagnetic driving mechanism 30, when a magnetizing current is applied to the second electromagnetic coil 309 from the intake-side driving circuit 30*a*, an electromagnetic force that acts in such a direction as to displace the armature 311 toward the second core 302 is generated between the side of the second core 302 (the second electromagnetic coil 309) and the armature 311. Therefore, the armature 311 is displaced toward its opening side against an urging force of the lower spring 316 and comes into abutment on the second core 302.

When the armature 311 abuts on the second core 302, the armature shaft 310 presses the valve shaft 28*b* in its opening direction against an urging force of the lower spring 316. The intake valve 28 is maintained in its fully-open state by the pressing force.

In the above-described intake-side electromagnetic driving mechanism 30, in the case where the intake valve 28 that is in its fully-closed state is opened, the intake-side driving circuit 30*a* first stops applying magnetizing current to the first electromagnetic coil 308.

At this moment, the electromagnetic force that is generated in the electromagnet composed of the first core 301 and the first electromagnetic coil 308 and that attracts the armature 311 terminates. Therefore, the armature 311 and the intake valve 28 are displaced in their opening directions while receiving an urging force of the upper spring 314.

Immediately after the armature 311 has been displaced to a position near the second core 302 while receiving an urging force of the upper spring 314, the intake-side driving circuit 30*a* applies magnetizing current to the second electromagnetic coil 309. Thus, an electromagnetic force that attracts the armature 311 to the second core 302 is generated among the second core 302, the second electromagnetic coil 309, and the armature 311. Because of this electromagnetic force, the armature 311 is displaced to such a position (opening-side displacement end) that the armature 311 abuts on the second core 302. As a result, the intake valve 28 assumes its fully-open state.

On the other hand, in the above-described intake-side electromagnetic driving mechanism 30, in the case where the intake valve 28 that is in its fully-open state is closed, the intake-side driving circuit 30*a* first stops applying magnetizing current to the second electromagnetic coil 309.

At this moment, the electromagnetic force that is generated in the electromagnet composed of the second core 302 and the second electromagnetic coil 309 and that attracts the armature 311 terminates. Therefore, the armature 311 and the intake valve 28 are displaced in their closing directions while receiving an urging force of the lower spring 316.

Immediately after the armature 311 has been displaced to a position near the first core 301 while receiving an urging force of the lower spring 316, the intake-side driving circuit 30*a* applies magnetizing current to the first electromagnetic coil 308. Thus, an electromagnetic force that attracts the armature 311 to the first core 301 is generated among the first core 301, the first electromagnetic coil 308, and the armature 311. Because of this electromagnetic force, the armature 311 is displaced to such a position (closing-side displacement end) that the armature 311 abuts on the first core 301. As a result, the valve body 28*a* of the intake valve 28 sits on the valve seat 12.

In this manner, the intake-side driving circuit 30*a* alternately applies magnetizing current to the first electromagnetic coil 308 and to the second electromagnetic coil 309 at predetermined timings. Thus, the armature 311 operates in a reciprocating manner between the closing-side displacement end and the opening-side displacement end. In accordance with this reciprocating movement, the valve shaft 28*b* is driven in a reciprocating manner, and at the same time, the valve body 28*a* is driven in its opening and closing directions.

Accordingly, the intake-side driving circuit 30*a* changes timings for application of magnetizing current to the first electromagnetic coil 308 and the second electromagnetic coil 309, whereby timings for opening and closing the intake valve 28 can be controlled arbitrarily.

The above-described intake-side electromagnetic driving mechanism 30 is provided with a lubricating mechanism that reduces a sliding resistance between the armature shaft 310 and the upper bush 319 and a sliding resistance between the armature shaft 310 and the lower bush 320.

The above-described lubricating mechanism has an annular upper-side recess 318*a*, an annular lower-side recess 307*a*, an upper-side oil passage 401, a lower-side oil passage 402, a communication passage 403, and a return passage 404.

The annular upper-side recess 318*a* is provided in the lower surface of the upper plate 318 in a region that faces an upper surface of the upper bush 319. The annular lower-side recess 307*a* is provided in an upper surface of the lower plate 307 in a region that faces the lower bush 320. The upper-side oil passage 401 introduces lubricating oil discharged from an oil pump (not shown) to the upper-side recess 318*a*. The lower-side oil passage 402 introduces lubricating oil discharged from the oil pump to the lower-side recess 307*a*. The communication passage 403 introduces to the lower-side recess 307*a* a surplus of lubricating oil that has been supplied to the upper-side recess 318*a*. The return passage 404 returns to an oil pan (not shown) lubricating oil that has fallen into the large-diameter portion 14*b* from the lower-side recess 307*a* through a clearance between the armature shaft 310 and the lower plate 307 and so on.

In the example shown in FIG. 3, the upper-side oil passage 401 is formed in such a manner as to extend from the oil pump to the upper-side recess 318*a* through the upper head 11, the flange 301*a* of the first core 301, and the inside of the upper plate 318. The lower-side oil passage 402 is formed in such a manner as to extend from the oil pump to the lower-side recess 307*a* through the upper head 11, the second core 302, and the inside of the lower plate 307. The communication passage 403 is formed in such a manner as to extend from the upper-side recess 318*a* to the lower-side recess 307*a* through the upper plate 318, the flange 301*a* of the first core 301, the upper head 11, the flange 302*a* of the second core 302, and the inside of the lower plate 307. Furthermore, the return passage 404 is formed in such a manner as to extend from the large-diameter portion 14*b* to the oil pan through the inside of the lower head 10.

Naturally, the structures of the upper-side oil passage 401, the lower-side oil passage 402, the communication passage 403, and the return passage 404 as described above are not limited to those shown in FIG. 3.

In the lubricating mechanism thus constructed, lubricating oil discharged from the oil pump is supplied to the upper-side recess 318*a* via the upper-side oil passage 401. The lubricating oil that has been supplied to the upper-side recess 318*a* enters a clearance between an outer peripheral surface of the armature shaft 310 and an inner peripheral surface of the upper bush 319, due to reciprocating movements of the armature shaft 310. The lubricating oil reduces friction occurring between the outer peripheral surface of the armature shaft 310 and the inner peripheral surface of the upper bush 319.

In the above-described lubricating mechanism, lubricating oil discharged from the oil pump is supplied to the lower-side recess 307*a* via the lower-side oil passage 402. A surplus of lubricating oil that has been supplied to the upper-side recess 318*a* is supplied to the lower-side recess 307*a* via the communication passage 403 from the upper-side recess 318*a*.

The lubricating oil that has been supplied to the lower-side recess 307*a* enters a clearance between the outer peripheral surface of the armature shaft 310 and the inner peripheral surface of the lower bush 320, due to reciprocating movements of the armature shaft 310. The lubricating oil reduces friction occurring between the outer peripheral surface of the armature shaft 310 and the inner peripheral surface of the lower bush 320.

A surplus of lubricating oil that has been supplied to the lower-side recess 307*a* enters the large-diameter portion 14*b* via the clearance between the armature shaft 310 and the lower plate 307 and so on, and then falls onto the upper surface of the lower head 10. The lubricating oil that has fallen onto the upper surface of the lower head 10 flows into the return passage 404 and is returned to the oil pan.

Such a lubricating mechanism reduces sliding resistance of the armature shaft 310. Therefore, the armature shaft 310 can move in a reciprocating manner by a relatively small electromagnetic force. As a result, the amount of magnetizing current to be applied to the first electromagnetic coil 308 and to the second electromagnetic coil 309 can be reduced.

Furthermore, the above-described intake-side electromagnetic driving mechanism 30 is fitted with a valve lift sensor 317 that detects displacement of the intake valve 28. The valve lift sensor 317 is composed of a target 317*a* in the shape of a circular plate and a gap sensor 317*b*. The target 317*a* in the shape of a circular plate is fitted to an upper surface of the upper retainer 312. The gap sensor 317*b* is fitted to the adjusting bolt 313 in a region that faces the upper retainer 312.

The target 317*a* is displaced together with the armature 311 of the intake-side electromagnetic driving mechanism 30. The gap sensor 317*b* outputs to a later-described electronic control unit (ECU) 20 an electric signal corresponding to a distance between the gap sensor 317*b* and the target 317*a*.

Herein, the ECU 20 stores in advance an output signal value that is generated by the gap sensor 317*b* when the armature 311 is in its neutral state. By calculating a difference between the output signal value and a current output signal value of the gap sensor 317*b*, displacement strokes of the armature 311 and the intake valve 28 can be determined specifically.

Referring again to FIGS. 1 and 2, an intake manifold 33 composed of four branch pipes is connected to the cylinder head 1*a* of the internal combustion engine 1. Each of the branch pipes of the intake manifold 33 is in communication with the intake port 26 of a corresponding one of the cylinders 21.

The cylinder head la is fitted with fuel injection valves 32 at positions close to regions for connection with the intake manifold 33 such that an injection hole of each of the fuel injection valves 32 is directed toward the inside of the intake port 26.

The intake manifold 33 is connected to a surge tank 34 for suppressing pulsation of intake air. The surge tank 34 is connected to an intake pipe 35. The intake pipe 35 is connected to an air cleaner box 36 for removing dirt, dust, and so on from intake air.

An air flow meter 44 that outputs an electric signal corresponding to a mass of air flowing through the intake pipe 35 (intake air mass) is fitted to the intake pipe 35. A throttle valve 39 that adjusts the amount of intake air flowing through the intake pipe 35 is provided in the intake pipe 35 in a region downstream of the air flow meter 44.

A throttle actuator 40 and a throttle position sensor 41 are fitted to the throttle valve 39.

The throttle actuator 40 is constructed of a stepper motor or the like and drives the throttle valve 39 in its opening and closing directions in accordance with a magnitude of applied voltage. The throttle position sensor 41 outputs an electric signal corresponding to an opening amount of the throttle valve 39.

An accelerator lever (not shown) is fitted to the throttle valve 39. This accelerator lever is rotatable independently of the throttle valve 39 and rotates in cooperation with an accelerator pedal 42. An accelerator position sensor 43 that outputs an electric signal corresponding to an amount of rotation of the accelerator lever is fitted to the accelerator lever.

On the other hand, an exhaust manifold 45 that is formed such that four branch pipes converge into one collective pipe immediately downstream of the internal combustion engine 1 is connected to the cylinder head 1*a* of the internal combustion engine 1. Each of the branch pipes of the exhaust manifold 45 is in communication with the exhaust port 27 of a corresponding one of the cylinders 21.

The exhaust manifold 45 is connected to an exhaust pipe 47 via an exhaust gas purifying catalyst 46. The exhaust pipe 47 is connected, at a position downstream thereof, to a muffler (not shown). An air-fuel ratio sensor 48 is fitted to the exhaust manifold 45. The air-fuel ratio sensor 48 outputs an electric signal that corresponds to an air-fuel ratio of exhaust gas flowing through the exhaust manifold 45 (i.e., exhaust gas flowing into the exhaust gas purifying catalyst 46).

For instance, the exhaust gas purifying catalyst 46 is a three-way catalyst, an absorption-reduction-type $NO_x$ catalyst, a selective-reduction-type $NO_x$ catalyst, or a catalyst obtained by suitably combining the aforementioned various catalysts.

The three-way catalyst purifies hydrocarbons (HC), carbon monoxide (CO), and nitrogen oxides ($NO_x$) included in exhaust gas when the air-fuel ratio of exhaust gas flowing into the exhaust gas purifying catalyst 46 is a predetermined air-fuel ratio close to the stoichiometric air-fuel ratio. The absorption-reduction-type $NO_x$ catalyst absorbs nitrogen oxides ($NO_x$) included in exhaust gas when the air-fuel ratio of exhaust gas flowing into the exhaust gas purifying catalyst 46 is lean, and discharges, reduces, and purifies the absorbed nitrogen oxides ($NO_x$) when the air-fuel ratio of exhaust gas flowing into the exhaust gas purifying catalyst 46 is stoichio-metric or rich. The selective-reduction-type $N_X$ catalyst reduces and purifies nitrogen oxides ($NO_x$) in exhaust gas when the air-fuel ratio of exhaust gas flowing into the exhaust gas purifying catalyst 46 indicates a state of excessive oxygen with a predetermined reducing agent being present.

The internal combustion engine 1 thus constructed is combined with the ECU 20 for controlling an operation state of the internal combustion engine 1.

Figure 4:
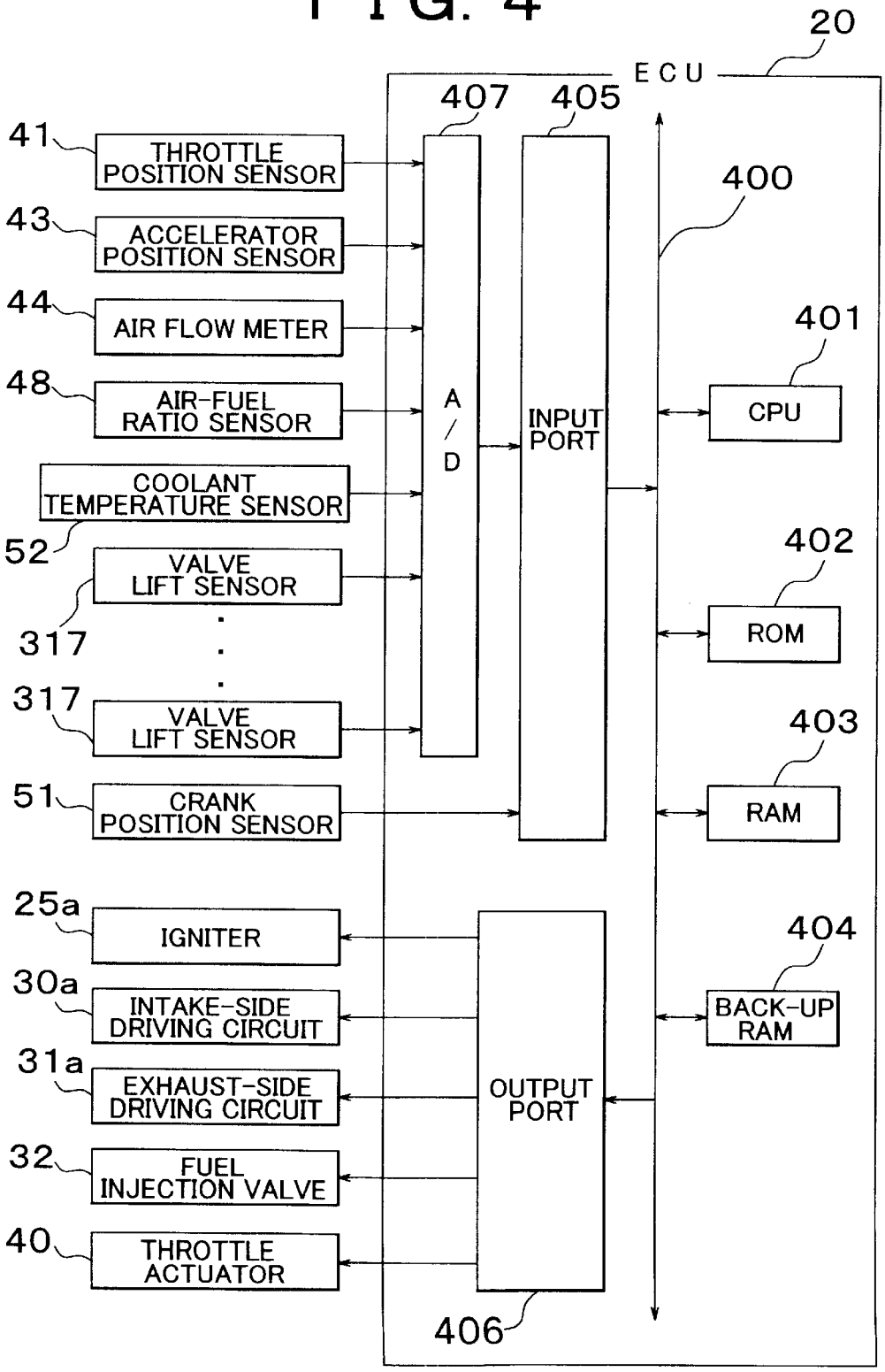
FIG. 4 is a block diagram of the internal structure of an ECU employed in the first embodiment of the invention.

As shown in FIG. 4, various sensors including the throttle position sensor 41, the accelerator position sensor 43, the air flow meter 44, the air-fuel ratio sensor 48, the crank position sensor 51, the coolant temperature sensor 52, the valve lift sensor 317, and so on are connected to the ECU 20 via electric wires. An output signal from each of the sensors is input to the ECU 20.

The igniter 25*a*, the intake-side driving circuit 30*a*, the exhaust-side driving circuit 31*a*, the fuel injection valve 32, the throttle actuator 40, and so on are connected to the ECU 20 via electric wires. Using output signal values of the sensors, the ECU 20 can control the igniter 25*a*, the intake-side driving circuit 30*a*, the exhaust-side driving circuit 31*a*, the fuel injection valve 32, and the throttle actuator 40.

The ECU 20 has a CPU 401, a ROM 402, a RAM 403, a back-up RAM 404, an input port 405, an output port 406, and an A/D converter (A/D) 407. The CPU 401, the ROM 402, the RAM 403, the back-up RAM 404, the input port 405, and the output port 406 are interconnected by a bi-directional bus 400. The A/D converter (A/D) 407 is connected to the input port 405.

The A/D 407 is connected to sensors outputting analog signals (the throttle position sensor 41, the accelerator position sensor 43, the air flow meter 44, the air-fuel ratio sensor 48, the coolant temperature sensor 52, the valve lift sensor 317, and so on) via electric wires. The A/D 407 performs analog-to-digital conversion of output signals from the aforementioned sensors, and then sends them to the input port 405.

The input port 405 is also connected to sensors outputting digital signals, such as the crank position sensor 51.

Output signals from the sensors are input to the input port 405 either directly or via the A/D 407. The input port 405 sends the output signals that have been input thereto from the sensors, to the CPU 401 and the RAM 403 via the bi-directional bus 400.

The output port 406 is connected to the igniter 25*a*, the intake-side driving circuit 30*a*, the exhaust-side driving circuit 31*a*, the fuel injection valves 32, the throttle actuator 40, and so on via electric wires. A control signal output from the CPU 401 is input to the output port 406 via the bi-directional bus 400. The output port 406 sends the control signal to the igniter 25*a*, the intake-side driving circuit 30*a*, the exhaust-side driving circuit 31*a*, the fuel injection valves 32, or the throttle actuator 40.

The ROM 402 stores a magnetizing current amount correction control routine in addition to application programs such as a fuel injection amount control routine, a fuel injection timing control routine, an intake-valve opening-and-closing timing control routine, an exhaust-valve opening-and-closing timing control routine, an intake-side magnetizing current amount control routine, an exhaust-side magnetizing current amount control routine, an ignition timing control routine, a throttle opening control routine, and so on.

The fuel injection amount control routine determines a fuel injection amount. The fuel injection timing control routine determines a fuel injection timing. The intake-valve opening-and-closing timing control routine determines timings for opening and closing the intake valve 28. The exhaust-valve opening-and-closing timing control routine determines timings for opening and closing the exhaust valve 29. The intake-side magnetizing current control routine determines an amount of magnetizing current to be applied to the intake-side electromagnetic driving mechanism 30. The exhaust-side magnetizing current amount control routine determines an amount of magnetizing current to be applied to the exhaust-side electromagnetic driving mechanism 31. The ignition timing control routine determines an ignition timing of the ignition plug 25 of each of the cylinders 21. The throttle opening control routine determines an opening of the throttle valve 39. A power consumption reduction control routine reduces power consumption of the exhaust-side electromagnetic driving mechanism 31 at a predetermined timing. The magnetizing current amount correction control routine corrects amounts of magnetizing current to be applied to the intake-side electromagnetic driving mechanism 30 and the exhaust-side electromagnetic driving mechanism 31, in accordance with a temperature of the lubricating oil.

The ROM 402 stores various control maps in addition to the above-described application programs. For instance, the above-described control maps include a fuel injection amount control map, a fuel injection timing control map, an intake-valve opening-and-closing timing control map, an exhaust-valve opening-and-closing timing control map, an intake-side magnetizing current amount control map, an exhaust-side magnetizing current amount control map, an ignition timing control map, a throttle opening control map, and so on.

The fuel injection amount control map shows a relation between an operation state of the internal combustion engine 1 and a fuel injection amount. The fuel injection timing control map shows a relation between an operation state of the internal combustion engine 1 and a fuel injection timing. The intake-valve opening-and-closing timing control map shows a relation between an operation state of the internal combustion engine 1 and timings for opening and closing the intake valves 28. The exhaust-valve opening-and-closing timing control map shows a relation between an operation state of the internal combustion engine 1 and timings for opening and closing the exhaust valves 29. The intake-side magnetizing current amount control map shows a relation between an operation state of the internal combustion engine 1 and an amount of magnetizing current to be applied to the intake-side electromagnetic driving mechanism 30. The exhaust-side magnetizing current amount control map shows a relation between an operation state of the internal combustion engine 1 and an amount of magnetizing current to be applied to the exhaust-side electromagnetic driving mechanism 31. The ignition timing control map shows a relation between an operation state of the internal combustion engine 1 and an ignition timing of each ignition plug 25. The throttle opening control map shows a relation between an operation state of the internal combustion engine 1 and an opening amount of the throttle valve 39.

The RAM 403 stores output signals from the sensors, calculation results of the CPU 401, and so on. For instance, the calculation results include an engine speed that is calculated based on an output signal from the crank position sensor 51, and so on. Various data stored in the RAM 403 are rewritten into latest data every time the crank position sensor 51 outputs a signal.

The back-up RAM 404 is a non-volatile memory that maintains data even after the internal combustion engine 1 has been turned off. The back-up RAM 404 stores learning values relating to various kinds of control, information for locating defective portions, and so on.

The CPU 401 operates in accordance with an application program stored in the ROM 402. The CPU 401 performs magnetizing current amount correction control in addition to well-known kinds of control, such as fuel injection control, ignition control, intake-valve opening-and-closing control, exhaust-valve opening-and-closing control, throttle control, and so on.

Hereinafter, magnetizing current amount correction control for the intake-side electromagnetic driving mechanism 30 and the exhaust-side electromagnetic driving mechanism 31 will be described.

In determining amounts of magnetizing current in the intake-side electromagnetic driving mechanism 30 and the exhaust-side electromagnetic driving mechanism 31, the CPU 401 performs the intake-side magnetizing current amount control routine and the exhaust-side magnetizing current amount control routine that are stored in the ROM 402 in advance.

Hereinafter, one example of the intake-side magnetizing current amount control routine and the exhaust-side magnetizing current amount control routine will be described. The CPU 401 reads out data stored in the RAM 403 (e.g., output signals from the sensors, engine speed, etc.), and determines an operation state of the internal combustion engine 1 based on the data. The CPU 401 then accesses the intake-side magnetizing current amount control map and the exhaust-side magnetizing current amount control map in the ROM 402, and calculates an amount of magnetizing current corresponding to the operation state of the internal combustion engine 1.

The CPU 401 controls the intake-side driving circuit 30*a* and the exhaust-side driving circuit 31*a* such that the aforementioned amount of magnetizing current is applied to the intake-side electromagnetic driving mechanism 30 and to the exhaust-side electromagnetic driving mechanism 31, and then performs feed-back control of the amount of magnetizing current based on an output signal value of the valve lift sensor 317.

As described in the foregoing description of FIG. 3, the intake-side electromagnetic driving mechanism 30 and the exhaust-side electromagnetic driving mechanism 31 are provided with mechanisms for supplying lubricating oil, in sliding regions such as a region where the armature shaft 310 is in contact with the upper bush 319 and a region where the armature shaft 310 is in contact with the lower bush 320. Therefore, generation of friction in the sliding regions as described above is suppressed. As a result, the intake-side electromagnetic driving mechanism 30 and the exhaust-side electromagnetic driving mechanism 31 can drive the intake valve 28 and the exhaust valve 29 in their opening and closing directions, with a relatively small amount of magnetizing current.

Lubricating oil has a characteristic whereby its viscosity changes in accordance with a temperature thereof. For example, the viscosity of lubricating oil increases as the temperature thereof falls, and the viscosity of lubricating oil decreases as the temperature thereof rises.

Therefore, in the intake-side electromagnetic driving mechanism 30 and the exhaust-side electromagnetic driving mechanism 31, sliding resistance of the armature shaft 310 increases when lubricating oil is at a low temperature. On the other hand, sliding resistance of the armature shaft 310 decreases when lubricating oil is at a high temperature. If the amount of magnetizing current applied to the intake-side electromagnetic driving mechanism 30 and to the exhaust-side electromagnetic driving mechanism 31 is constant irrespective of a temperature of the lubricating oil, the operating speed of the armature shaft 310 decreases in proportion to a fall in temperature of the lubricating oil and increases in proportion to a rise in temperature of the lubricating oil. That is, if the amount of magnetizing current applied to the intake-side electromagnetic driving mechanism 30 and to the exhaust-side electromagnetic driving mechanism 31 is constant irrespective of a temperature of lubricating oil, opening-and-closing operation speeds of the intake valve 28 and the exhaust valve 29 change depending on a temperature of lubricating oil.

Therefore, in the internal combustion engine having the electromagnetic valve driving mechanism according to an embodiment of the invention, the CPU 401 applies magnetizing current to the intake-side electromagnetic driving mechanism 30 and to the exhaust-side electromagnetic driving mechanism 31 from the intake-side driving circuit 30*a* and the exhaust-side driving circuit 31*a*, respectively. The CPU 401 then performs magnetizing current amount correction control so as to correct the amount of magnetizing current based on a temperature of the lubricating oil.

Figure 5:
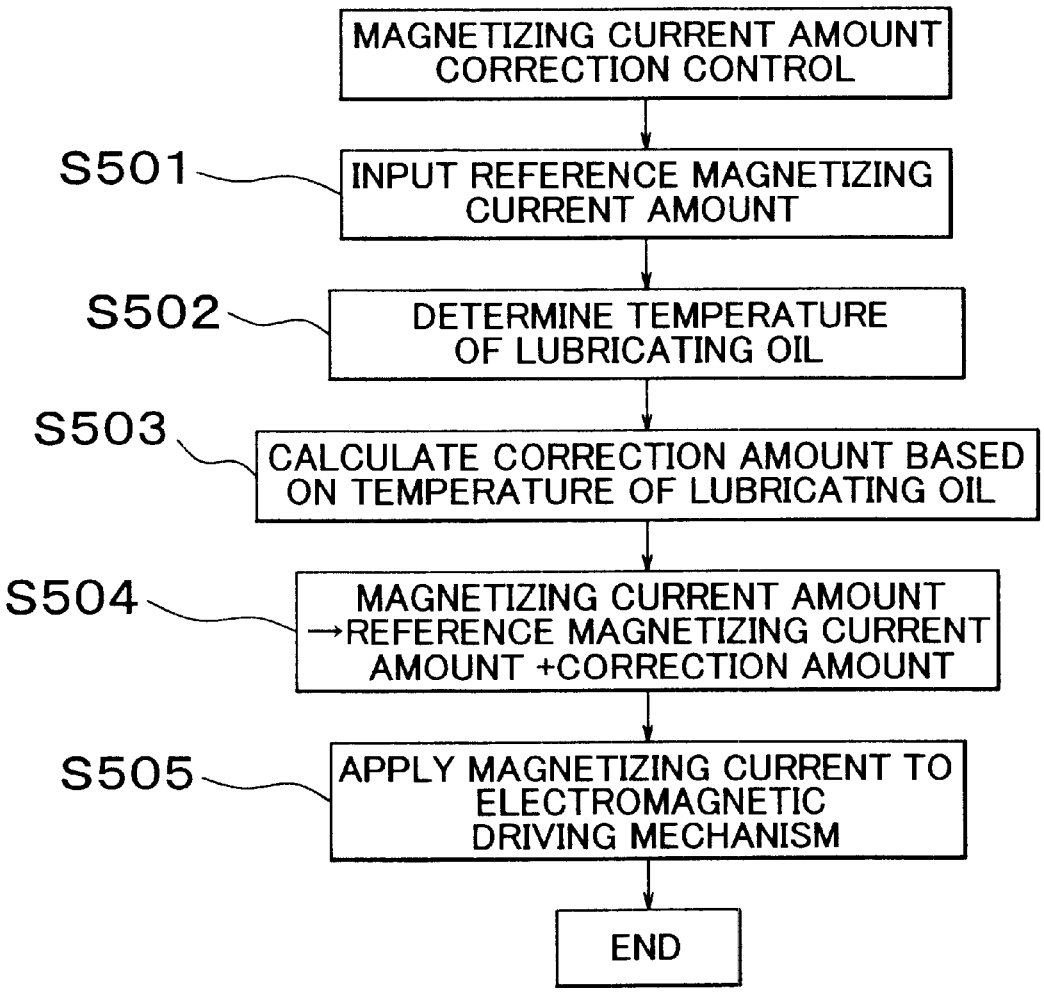
FIG. 5 is a flowchart of a magnetizing current amount correction control routine according to the first embodiment of the invention.

In performing magnetizing current amount correction control, the CPU 401 performs the magnetizing current amount correction control routine as shown in FIG. 5. This magnetizing current amount correction control routine is stored in advance in the ROM 402 of the ECU 20. The magnetizing current amount correction control routine is repeatedly carried out by the CPU 401 at intervals of a predetermined period (e.g., every time the crank position sensor 51 outputs a pulse signal).

In the magnetizing current amount correction control routine, the CPU 401 reads out from the RAM 403, first in S501, an amount of magnetizing current that has been separately determined by the magnetizing current amount control routine. It is to be noted herein that the amount of magnetizing current is determined based on the intake-side magnetizing current amount control map and the exhaust-side magnetizing current amount control map or by feed-back control based on an output signal from the valve lift sensor 317.

Hereinafter, the amount of magnetizing current that has been determined based on the intake-side magnetizing current amount control map and the exhaust-side magnetizing current amount control map and the amount of magnetizing current that has been determined by feed-back control based on an output signal from the valve lift sensor 317 will be referred to as reference magnetizing current amounts.

In S502, the CPU 401 detects or estimates (i.e., determines) a temperature of lubricating oil in the intake-side electromagnetic driving mechanism 30 and in the exhaust-side electromagnetic driving mechanism 31.

The following methods are examples of methods of detecting a temperature of lubricating oil in the intake-side electromagnetic driving mechanism 30 and in the exhaust-side electromagnetic driving mechanism 31. An oil temperature sensor for detecting a temperature of lubricating oil flowing through the upper-side oil passage 401 or the lower-side oil passage 402 of at least one of the intake-side electromagnetic driving mechanism 30 and the exhaust-side electromagnetic driving mechanism 31 can be fitted to at least one of the intake-side electromagnetic driving mechanism 30 and the exhaust-side electromagnetic driving mechanism 31. In the case where the above-described lubricating oil is also used as lubricating oil for the internal combustion engine 1, an output signal from an oil temperature sensor (not shown) fitted to the internal combustion engine 1 can be utilized.

On the other hand, as a method of estimating a temperature of lubricating oil in the intake-side electromagnetic driving mechanism 30 and in the exhaust-side electromagnetic driving mechanism 31, a method of estimation using a temperature of coolant in the internal combustion engine 1 (an output signal value of the coolant temperature sensor 52) as a parameter can be used, for example.

In S503, the CPU 401 calculates a correction amount for the reference magnetizing current amount using as a parameter the temperature of lubricating oil that has been detected or estimated in S502. The CPU 401 then calculates a correction amount for the reference magnetizing current amount such that the amount of magnetizing current used in the intake-side electromagnetic driving mechanism 30 and in the exhaust-side electromagnetic driving mechanism 31 increases in proportion to a fall in temperature of the lubricating oil, and decreases in proportion to a rise in temperature of the lubricating oil. It is possible to preliminary obtain a relation between temperature of the lubricating oil and correction amount through experiments, express the relation in the form of a map, and store it into the ROM 402. When lubricating oil is at a temperature that is higher than a predetermined temperature, the amount of magnetizing current can be made smaller than the reference magnetizing current amount.

Moreover, when lubricant is at a temperature that is lower than a predetermined temperature, the amount of magnetizing current can be made greater than the reference magnetizing current amount. The predetermined temperature for making the amount of magnetizing current smaller than the reference magnetizing current amount and the predetermined temperature for making the amount of magnetizing current greater than the reference magnetizing current amount may be equal to each other or different from each other.

In S504, the CPU 401 adds the correction amount that has been calculated in S503 to the reference magnetizing current amount that has been read out in S501, and calculates an amount of magnetizing current to be actually applied to the intake-side electromagnetic driving mechanism 30 and to the exhaust-side electromagnetic driving mechanism 31.

In S505, the CPU 401 controls the intake-side driving circuit 30*a* and the exhaust-side driving circuit 31*a* such that the amount of magnetizing current calculated in S504 is applied to the intake-side electromagnetic driving mechanism 30 and to the exhaust-side electromagnetic driving mechanism 31 respectively.

In this case, the amount of applied magnetizing current corresponds to a temperature of the lubricating oil. For example, the amount of magnetizing current applied to the intake-side electromagnetic driving mechanism 30 and to the exhaust-side electromagnetic driving mechanism 31 increases in proportion to a fall in temperature of lubricating oil. On the other hand, the amount of magnetizing current applied to the intake-side electromagnetic driving mechanism 30 and to the exhaust-side electromagnetic driving mechanism 31 decreases in proportion to a rise in temperature of lubricating oil.

That is, according to the above-described magnetizing current amount correction control, the amount of magnetizing current applied to the intake-side electromagnetic driving mechanism 30 and to the exhaust-side electromagnetic driving mechanism 31 increases in proportion to a rise in viscosity of the lubricating oil. On the other hand, the amount of magnetizing current applied to the intake-side electromagnetic driving mechanism 30 and to the exhaust-side electromagnetic driving mechanism 31 decreases in proportion to a fall in viscosity of the lubricating oil.

As a result, in the intake-side electromagnetic driving mechanism 30 and in the exhaust-side electromagnetic driving mechanism 31, when the lubricating oil has a high viscosity, the armature 311 and the armature shaft 310 are driven by a relatively great electromagnetic force. On the other hand, when the lubricating oil has a low viscosity, the armature 311 and the armature shaft 310 are driven by a relatively small electromagnetic force.

Thus, according to the internal combustion engine having the electromagnetic valve driving mechanism of the invention, when the lubricating oil in the intake-side electromagnetic driving mechanism 30 and in the exhaust-side electromagnetic driving mechanism 31 has a high viscosity, the armature 311 and the armature shaft 310 can be displaced smoothly against the viscosity of the lubricating oil. When the lubricating oil has a low viscosity, displacement speeds of the armature 311 and of the armature shaft 310 do not rise excessively. Therefore, changes in opening-and-closing operation speeds of the intake and exhaust valves 28, 29 resulting from a temperature or viscosity of the lubricating oil can be reduced.

This embodiment demonstrated an example in which only the amount of magnetizing current to be applied to the intake-side electromagnetic driving mechanism 30 and to the exhaust-side electromagnetic driving mechanism 31 is corrected in accordance with a temperature of the lubricating oil. However, the amount of magnetizing current and the timing for application of magnetizing current may be corrected in accordance with a temperature of the lubricating oil.

Figure 6:
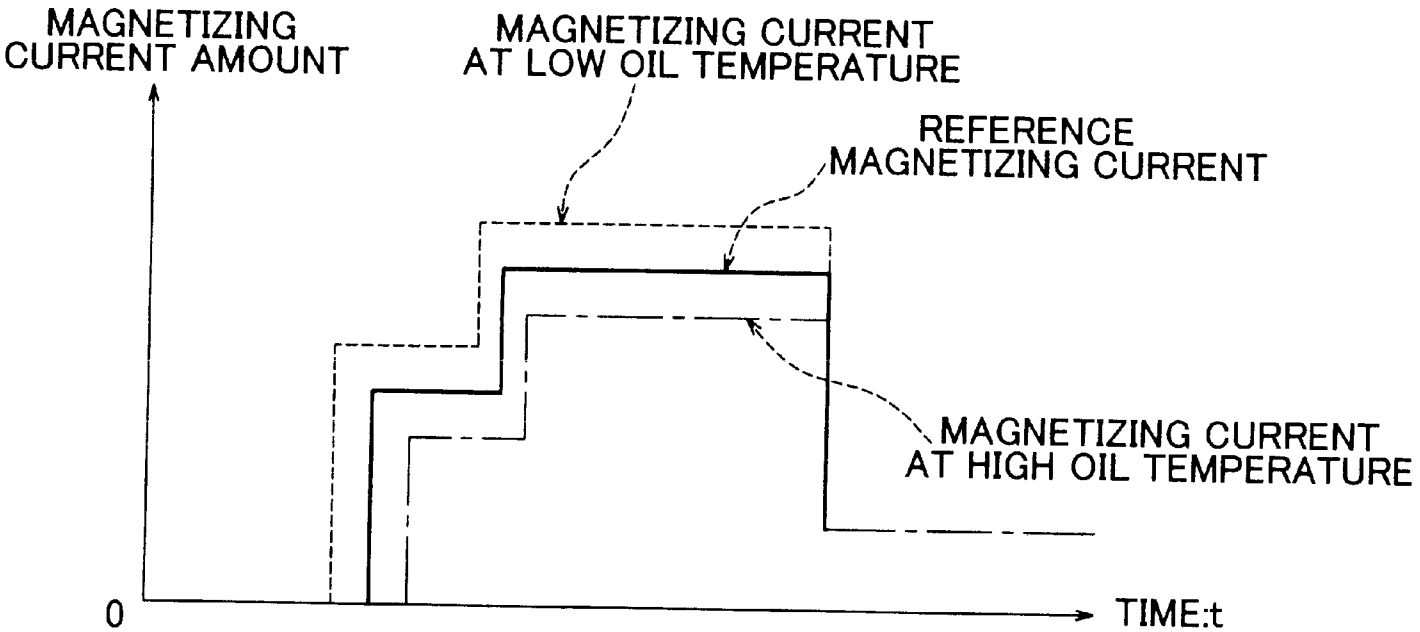
FIG. 6 shows the amount of magnetizing current and timing for application of magnetizing current in accordance with the temperature of the lubricating oil in second embodiment of the invention.

For instance, as shown in FIG. 6 ( second embodiment in the invention ), when the lubricating oil is at a low temperature, the amount of magnetizing current to be applied to the intake-side electromagnetic driving mechanism 30 and to the exhaust-side electromagnetic driving mechanism 31 is increased, and the timing for application of magnetizing current is advanced. On the other hand, when the lubricating oil is at a high temperature, the amount of magnetizing current to be applied to the intake-side electromagnetic driving mechanism 30 and to the exhaust-side electromagnetic driving mechanism 31 is reduced, and at the same time, the timing for application of magnetizing current may be retarded.

In the above-described internal combustion engine having the electromagnetic valve driving mechanism according to an embodiment of the invention, the amount of magnetizing current applied to the electromagnetic valve driving mechanism is adjusted in accordance with a temperature of the lubricant. Therefore, the amount of magnetizing current to be applied to the electromagnetic valve driving mechanism can be increased when the lubricant is at a low temperature (with a high viscosity), whereas the amount of magnetizing current to be applied to the electromagnetic valve driving mechanism can be reduced when the lubricant is at a high temperature (with a low viscosity).

As a result, the electromagnetic valve driving mechanism can drive the intake and exhaust valves with a relatively great electromagnetic force when the lubricant has a high viscosity, and can drive the intake and exhaust valves with a relatively small electromagnetic force when the lubricant has a low viscosity.

The intake-side electromagnetic driving mechanism 30 and the exhaust-side electromagnetic driving mechanism 31 of the above-described embodiment correspond to the electromagnetic valve driving mechanism of the invention. The ECU 20 in the above-described embodiment corresponds to a controller and a current amount adjusting means of the invention.

In the above-described embodiments, the amount of magnetizing current applied to the electromagnetic valve driving mechanism is adjusted in accordance with a temperature of the lubricant (in the above-described embodiment, lubricating oil is one example of lubricant). However, as a matter of course, the amount of magnetizing current applied to the electromagnetic valve driving mechanism may be adjusted in accordance with a viscosity of the lubricant.

Thus, according to the internal combustion engine having the electromagnetic valve driving mechanism of the invention, the intake and exhaust valves can be driven with an electromagnetic force corresponding to a viscosity of the lubricant, and changes in opening-and-closing operation speeds of the intake and exhaust valves resulting from a temperature or viscosity of the lubricant can be reduced.

In the illustrated embodiment, the apparatus is controlled by the controller (e.g., the ECU 20), which is implemented as a programmed general purpose computer. It will be appreciated by those skilled in the art that the controller can be implemented using a single special purpose integrated circuit (e.g., ASIC) having a main or central processor section for overall, system-level control, and separate sections dedicated to performing various different specific computations, functions and other processes under control of the central processor section. The controller can be a plurality of separate dedicated or programmable integrated or other electronic circuits or devices (e.g., hardwired electronic or logic circuits such as discrete element circuits, or programmable logic devices such as PLDs, PLAs, PALs or the like). The controller can be implemented using a suitably programmed general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein can be used as the controller. A distributed processing architecture can be used for maximum data/signal processing capability and speed.

While the invention has been described with reference to preferred embodiments thereof, it is to be understood that the invention is not limited to the preferred embodiments or constructions. To the contrary, the invention is intended to cover various modifications and equivalent arrangements. In addition, while the various elements of the preferred embodiments are shown in various combinations and configurations, which are exemplary, other combinations and configurations, including more, less or only a single element, are also within the spirit and scope of the invention.

What is claimed is:

1. An internal combustion engine comprising:

an electromagnetic valve driving mechanism that drives at least one of an intake valve and an exhaust valve of the internal combustion engine in opening and closing directions by an electromagnetic force that is generated upon application of a magnetizing current thereto;

a lubricant temperature determining device that determines a temperature of lubricant that is supplied to at least one of a sliding portion of the electromagnetic valve driving mechanism, a sliding portion of the intake valve driven by the electromagnetic valve driving mechanism, and a sliding portion of the exhaust valve driven by the electromagnetic valve driving mechanism; and a controller that controls a timing for application of the magnetizing current supplied to the electromagnetic valve driving mechanism in accordance with the temperature of the lubricant that has been determined by the lubricant temperature determining device.

2. The internal combustion engine according to claim 1, wherein the controller advances the timing for application of the magnetizing current supplied to the electromagnetic valve driving mechanism in proportion to a decrease in the determined temperature of the lubricant.

3. The internal combustion engine according to claim 1, wherein the controller adjusts an amount of the magnetizing current supplied to the electromagnetic valve driving mechanism in accordance with the determined temperature of the lubricant.

4. The internal combustion engine according to claim 3, wherein the controller advances the timing for application of the magnetizing current supplied to the electromagnetic valve driving mechanism in proportion to a decrease in the determined temperature of the lubricant.

5. The internal combustion engine according to claim 4, wherein the controller increases the amount of the magnetizing current supplied to the electromagnetic valve driving mechanism in proportion to the decrease in the determined temperature of the lubricant.

6. An internal combustion engine comprising:

an electromagnetic valve driving mechanism that drives at least one of an intake valve and an exhaust valve of the internal combustion engine in opening and closing directions by an electromagnetic force that is generated upon application of a magnetizing current thereto;

a lubricant viscosity determining device that determines a viscosity of a lubricant that is supplied to at least one of a sliding portion of the electromagnetic valve driving mechanism, a sliding portion of the intake valve driven by the electromagnetic valve driving mechanism, and a sliding portion of the exhaust valve driven by the electromagnetic valve driving mechanism; and a controller that controls a timing for application of the magnetizing current supplied to the electromagnetic valve driving mechanism in accordance with the viscosity of the lubricant that has been determined by the lubricant viscosity determining device.

7. The internal combustion engine according to claim 6, wherein the controller advances the timing for application of the magnetizing current supplied to the electromagnetic valve driving mechanism in proportion to an increase in the determined viscosity of the lubricant.

8. The internal combustion engine according to claim 6, wherein the controller adjusts an amount of the magnetizing current supplied to the electromagnetic valve driving mechanism in accordance with the determined viscosity of the lubricant.

9. The internal combustion engine according to claim 8, wherein the controller advances the timing for application of the magnetizing current supplied to the electromagnetic valve driving mechanism in proportion to an increase in the determined viscosity of the lubricant.

10. The internal combustion engine according to claim 9, wherein the controller increases the amount of the magnetizing current supplied to the electromagnetic valve driving mechanism in proposition to the increase in the determined viscosity of the lubricant.

* * * * *